US012006618B2

(12) United States Patent
Beninato et al.

(10) Patent No.: US 12,006,618 B2
(45) Date of Patent: Jun. 11, 2024

(54) LAUNDRY TREATMENT APPLIANCE WITH DRY ESTIMATE OF THE AMOUNT OF LAUNDRY LOAD

(71) Applicant: Electrolux Appliances Aktiebolag, Stockholm (SE)

(72) Inventors: Daniele Beninato, Charlotte, NC (US); Andrea Mazzon, Porcia (IT); Martino Bondi, Porcia (IT); Andrea Zattin, Porcia (IT); Elisa Stabon, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 261 days.

(21) Appl. No.: 17/439,478

(22) PCT Filed: Mar. 11, 2020

(86) PCT No.: PCT/EP2020/056526
§ 371 (c)(1),
(2) Date: Sep. 15, 2021

(87) PCT Pub. No.: WO2020/193139
PCT Pub. Date: Oct. 1, 2020

(65) Prior Publication Data

US 2022/0154382 A1 May 19, 2022

(30) Foreign Application Priority Data

Mar. 27, 2019 (EP) ..... 19165528

(51) Int. Cl.
*D06F 34/18* (2020.01)
*D06F 33/37* (2020.01)
(Continued)

(52) U.S. Cl.
CPC ..... *D06F 34/18* (2020.02); *D06F 33/37* (2020.02); *D06F 33/48* (2020.02); *D06F 39/022* (2013.01)

(58) Field of Classification Search
CPC ..... D06F 33/32; D06F 33/34; D06F 33/37; D06F 33/44; D06F 33/46; D06F 33/52;
(Continued)

(56) References Cited

U.S. PATENT DOCUMENTS 4,607,408 A 8/1986 Didier et al.
2009/0205377 A1 8/2009 Suel, II et al.
(Continued)

FOREIGN PATENT DOCUMENTS

CN 103321013 A 9/2013
CN 107002335 A 8/2017
(Continued)

OTHER PUBLICATIONS

International Search Report and Written Opinion for International Application No. PCT/EP2020/056526, dated May 4, 2020, 9 pages.
Chinese Office Action with Search Report for Chinese Application No. 202080023682.1, dated May 18, 2023 with translation, 19 pages.
(Continued)

*Primary Examiner* — David G Cormier
(74) *Attorney, Agent, or Firm* — Bradley Arant Boult Cummings LLP

(57) ABSTRACT

A laundry treatment appliance having a rotatable drum, an electric motor; at least one compartment to contain multiple doses of treatment agent, and a control unit The control unit is configured to, before delivering water: rotate the drum with a predefined speed profile comprising an accelerating ramp speed profile portion and a constant speed profile portion; estimate the amount of laundry load according to one or more parameters of the electric motor acquired during the drum rotation with the predefined speed profile; and according to said estimate, determine a treatment agent dose
(Continued)

to be used during the selected laundry treatment cycle. The control unit is configured to, after determining the treatment agent dose, deliver water to the laundry load, and deliver the determined treatment agent dose to the laundry load.

20 Claims, 6 Drawing Sheets

(51) Int. Cl.
*D06F 33/48* (2020.01)
*D06F 39/02* (2006.01)

(58) Field of Classification Search
CPC ..... D06F 33/54; D06F 33/57; D06F 33/70; D06F 33/72; D06F 34/18; D06F 2103/04; D06F 2103/46; D06F 2105/02; D06F 2105/42; D06F 2105/46; D06F 2105/48; D06F 2105/52; D06F 2105/56
See application file for complete search history.

(56) References Cited

U.S. PATENT DOCUMENTS

| | | | | |
|---|---|---|---|---|
| 2010/0101030 | A1 | 4/2010 | Kim | |
| 2020/0040506 | A1* | 2/2020 | Lee | D06F 33/34 |

FOREIGN PATENT DOCUMENTS

| | | | |
|---|---|---|---|
| CN | 107313226 | A | 11/2017 |
| CN | 109312520 | A | 2/2019 |
| EP | 3 162 942 | | 5/2017 |
| EP | 3162943 | A1 | 5/2017 |
| EP | 3241938 | A1 | 11/2017 |
| EP | 3348694 | A1 | 7/2018 |

OTHER PUBLICATIONS

European Office Action dated Apr. 10, 2024 of corresponding European Patent Application No. 19 165 528.1.

* cited by examiner

LAUNDRY TREATMENT APPLIANCE WITH DRY ESTIMATE OF THE AMOUNT OF LAUNDRY LOAD

This application is a U.S. National Phase application of PCT International Application No. PCT/EP2020/056526, filed Mar. 11, 2020, which claims the benefit of European Application No. 19165528.1, filed Mar. 27, 2019, both of which are incorporated by reference herein.

FIELD OF THE INVENTION

The present invention generally relates to the field of laundry treatment appliances (hereinafter, concisely, "laundry appliances"), and particularly to laundry appliances for treating, e.g. washing, items (such as linen, clothes, garments, shoes, and the like), such as laundry washing appliances and laundry washing appliances also implementing laundry drying functions (also referred to as washers/dryers). More particularly, the present invention relates to a laundry appliance capable of providing an estimate of an amount of laundry load contained therein.

BACKGROUND OF THE INVENTION

A laundry appliance typically comprises a drawer having drawer compartments for containing one or more treatment agents.

In an increasingly common type of laundry appliance, the drawer comprises one or more compartments each one adapted to contain multiple doses of a respective treatment agent for performing multiple washing cycles (hereinafter referred to as multi-dose compartments): just as an example, in case of two multi-dose compartments, a multi-dose compartment may be arranged to contain multiple doses of a liquid washing detergent, whereas the other multi-dose compartment may be arranged to contain multiple doses of a liquid softener. In this class of laundry appliance, the laundry appliance may implement an auto-dosing functionality in which, at each washing cycle (and when the auto-dosing functionality is activated), an amount of treatment agent (hereinafter, treatment agent dose) is automatically drawn up from the multi-dose compartment(s) (e.g., by means of one or more pump devices associated therewith) and dispensed to a treatment chamber (such as a washing tub).

SUMMARY OF INVENTION

The Applicant has realized that the typical laundry appliances implementing the auto-dosing functionality are not satisfactory.

According to the Applicant, this is substantially due to the fact that in most of known solutions the amount of treatment agent to be drawn up from the multi-dose compartment(s) and dispensed to the treatment chamber cannot be adapted to an actual amount of laundry load to be treated.

The Applicant is aware of the presence on the market of laundry appliances configured to determine an estimate of the amount of the laundry loaded in order to set one or more parameters of a treatment cycle (such as amount of water/detergent to be loaded, and treatment cycle duration), in which the estimate of the amount of laundry load is indirectly performed (at the beginning of the treatment cycle) based on water absorption by the laundry load during a water loading phase of the treatment cycle; however the Applicant believes that such an estimate of the amount of laundry load cannot be adapted to laundry appliances featuring the auto-dosing functionality.

Indeed, such an estimate of the amount laundry load strongly depends on a water adsorption degree of the fabric/textile of the laundry load, whereby relatively long times are necessary to provide an accurate estimate of the amount of laundry load. This implies that the required amount of treatment agent to be loaded for the treatment cycle is completely released only after the estimate of the amount laundry load has been determined/completed—with the required amount of treatment agent to be loaded for the treatment cycle that may for example be released at once (e.g., with a single treatment agent dose) after completing the estimate of the amount laundry load, or in a distributed manner (e.g., with two or more treatment agent doses released while progressively updating the estimate of the amount laundry load, before completing it). This strongly affects the efficiency of the laundry treatment, both due to the belatedly interaction of the treatment agent with the laundry load (e.g., when the required amount of treatment agent to be loaded for the treatment cycle is released at once after completing the estimate of the amount laundry load), and to the use of partial amounts of treatment agent during some treatment cycle phases (e.g., when the required amount of treatment agent to be loaded for the treatment cycle is released in a distributed manner before completing the estimate of the amount laundry load).

In view of the above, it is an object of the present invention to provide a laundry appliance able to overcome these, as well as other, drawbacks, and particularly it is an object of the present invention to provide a laundry appliance featuring the auto-dosing functionality which is capable of quickly determining the amount of treatment agent to be loaded for the treatment cycle and to completely release it at the very first phase(s) of the treatment cycle.

One or more aspects of the present invention are set out in the independent claims, with advantageous features of the same invention that are indicated in the dependent claims.

An aspect of the present invention relates to a laundry treatment appliance.

The laundry treatment appliance comprises:

- a rotatable drum adapted to house a laundry load to be treated;
- an electric motor adapted to rotate the rotatable drum;
- at least one compartment adapted to contain multiple doses of a treatment agent for laundry treatment, and
- a control unit for controlling laundry treatment appliance operation.

The control unit is preferably configured to:

(i) before any delivery of water to the laundry load during a selected laundry treatment cycle:
  - control the electric motor to cause said rotatable drum to be rotated with a predefined speed profile comprising a ramp speed profile portion in which the rotatable drum is accelerated from a first rotational speed to a second rotational speed higher than the first rotational speed, and a constant speed profile portion in which the rotatable drum is constantly rotated at said second rotational speed;
  - determine an estimate of the amount of laundry load according to one or more parameters of the electric motor being acquired during rotation of the rotatable drum with the predefined speed profile;
  - according to said estimate of the amount of laundry load, determine a treatment agent dose to be used during the selected laundry treatment cycle, and (ii) after having determined the treatment agent dose to be used during the selected laundry treatment cycle:
cause delivery of water to the laundry load, and
cause delivery of the determined treatment agent dose to the laundry load.

According to an embodiment of present invention, additional or alternative to any of the previous embodiments, the control unit is configured to cause said delivery of the determined treatment agent dose together with said delivery of water, preferably together with the delivery of a partial amount of water.

According to an embodiment of present invention, additional or alternative to any of the previous embodiments, the control unit is configured to cause said delivery of the determined treatment agent dose after said delivery of water, preferably after the delivery of a partial amount of water.

According to an embodiment of present invention, additional or alternative to any of the previous embodiments, said one or more parameters of the electric motor comprises a torque of the electric motor.

According to an embodiment of present invention, additional or alternative to any of the previous embodiments, the control unit is configured to determine first and second torques of said electric motor during rotation of the rotatable drum with said ramp and constant speed profile portions, respectively, and preferably to determine said estimate of the amount of laundry load according to said first and second torques.

According to an embodiment of present invention, additional or alternative to any of the previous embodiments, the control unit is configured to determine said first and second torques by determining a plurality of first torques according to a respective first sample time during rotation of the rotatable drum with the ramp speed profile portion and a plurality of second torques according to a respective second sample time during rotation of the rotatable drum with the constant speed profile portion. The control unit is advantageously configured to determine the estimate of the amount of laundry load according to an integral function, over said first sample time, with respect to said plurality of first torques subtracted by an average torque among said plurality of second torques.

According to an embodiment of present invention, additional or alternative to any of the previous embodiments, the predefined speed profile comprises a plurality of drum speed commutations each one comprising said ramp and constant speed profile portions. The control unit is advantageously configured to calculate said integral function for each drum speed commutation thereby obtaining a plurality of integral functions. The control unit is advantageously configured to determine the estimate of the amount of laundry load according to a difference between each integral function and an average integral function among said plurality of integral functions.

According to an embodiment of present invention, additional or alternative to any of the previous embodiments, the predefined speed profile further comprises a further ramp speed profile portion in which the rotatable drum is decelerated from said second rotational speed to said first rotational speed. Preferably, said constant speed profile portion immediately follows said ramp speed profile portion and immediately preceding said further ramp speed profile portion.

According to an embodiment of present invention, additional or alternative to any of the previous embodiments, the control unit is further configured to:

if the estimate of the amount of laundry load is above a threshold amount of laundry load, determine a further estimate of the amount of laundry load based on water absorption by the laundry load and preferably determine at least one parameter of the selected laundry treatment cycle based on said further estimate of the amount of laundry load; and if the estimate of the amount of laundry load is below said threshold amount of laundry load, determine said at least one parameter of the selected laundry treatment cycle based on said estimate of the amount of laundry load.

Advantageously, the further estimate of the amount of laundry load and the at least one parameter of the selected laundry treatment cycle do not affect the determined treatment agent dose According to an embodiment of present invention, additional or alternative to any of the previous embodiments, if the estimate of the amount of laundry load is above the threshold amount of laundry load the control unit is configured to cause said delivery of water to the laundry load by iteratively causing the delivery of a predetermined amount of water, waiting a predetermined time interval, determining a water level variation in the rotatable drum within the predetermined time interval, and stopping water delivery if said water level variation is below or equal to a threshold water level variation. The control unit is advantageously configured to determine the further estimate of the amount of laundry load based on water absorption by the laundry load according to the amount of water added in the drum up to the stopping of water delivery.

According to an embodiment of present invention, additional or alternative to any of the previous embodiments, said at least one parameter of the selected laundry treatment cycle comprises at least one among time duration of the selected laundry treatment cycle and amount of water to be delivered during the selected laundry treatment cycle. Advantageously, the determined treatment agent dose is not affected by the time duration of the selected laundry treatment cycle and amount of water to be delivered during the selected laundry treatment cycle According to an embodiment of present invention, additional or alternative to any of the previous embodiments, according to said estimate of the amount of laundry load, the control unit is further configured to determine, and preferably display, a first time duration of the selected laundry treatment cycle. Preferably, if the estimate of the amount of laundry load is above the threshold amount of laundry load, the control unit is further configured to determine, and preferably display, a second time duration of the selected laundry treatment cycle based on the further estimate of the amount of laundry load. Advantageously, the determined treatment agent dose is not affected by the first and second time durations.

According to an embodiment of present invention, additional or alternative to any of the previous embodiments, the control unit is configured to determine the second time duration of the selected laundry treatment cycle based on the further estimate of the amount of laundry load, independently from the estimate of the amount of laundry load.

According to an embodiment of present invention, additional or alternative to any of the previous embodiments, if the estimate of the amount of laundry load is below the threshold amount of laundry load, the control unit is configured to gradually update said first time duration while executing the laundry treatment cycle, without determining said second time duration.

According to an embodiment of present invention, additional or alternative to any of the previous embodiments, the control unit is configured to determine said further estimate of the amount of laundry load and/or said at least one parameter of the selected laundry treatment cycle also based on at least one among water hardness, dirt level of the laundry load, color of the laundry load and fabric type of the laundry load.

According to an embodiment of present invention, additional or alternative to any of the previous embodiments, the control unit is further configured to compare at least one among the first and second torques with respective first and second threshold torques. The control unit is advantageously configured to determine the estimate of the amount of laundry load from said first and second torques if said at least one among the first and second torques is below the respective first and second threshold torques.

According to an embodiment of present invention, additional or alternative to any of the previous embodiments, if said at least one among the first and second torques is above the respective first and second threshold torques, the control unit is configured to determine an estimate of the amount of laundry load by setting the selected laundry treatment cycle for a maximum amount of laundry load accepted by the laundry treatment appliance. Advantageously, the treatment agent dose to be used during the selected laundry treatment cycle is determined by the control unit according to said maximum amount of laundry load.

According to an embodiment of present invention, additional or alternative to any of the previous embodiments, the control unit is configured to emit a warning signal if the selected laundry treatment cycle is not compatible with said maximum load accepted by the laundry treatment appliance. Advantageously, the treatment agent dose to be used during the selected laundry treatment cycle is determined by the control unit according to said maximum amount of laundry load if the selected laundry treatment cycle is compatible with said maximum load accepted by the laundry treatment appliance.

According to an embodiment of present invention, additional or alternative to any of the previous embodiments, the control unit is configured to determine the treatment agent dose to be used during the selected laundry treatment cycle also based on a predefined treatment agent dose.

According to an embodiment of present invention, additional or alternative to any of the previous embodiments, said predefined treatment agent dose is determined by the control unit according at least one property of the treatment agent.

According to an embodiment of present invention, additional or alternative to any of the previous embodiments, the laundry treatment appliance is configured to automatically recognize said at least one property of the treatment agent, or to allow manual input of said at least one property of the treatment agent by a user.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
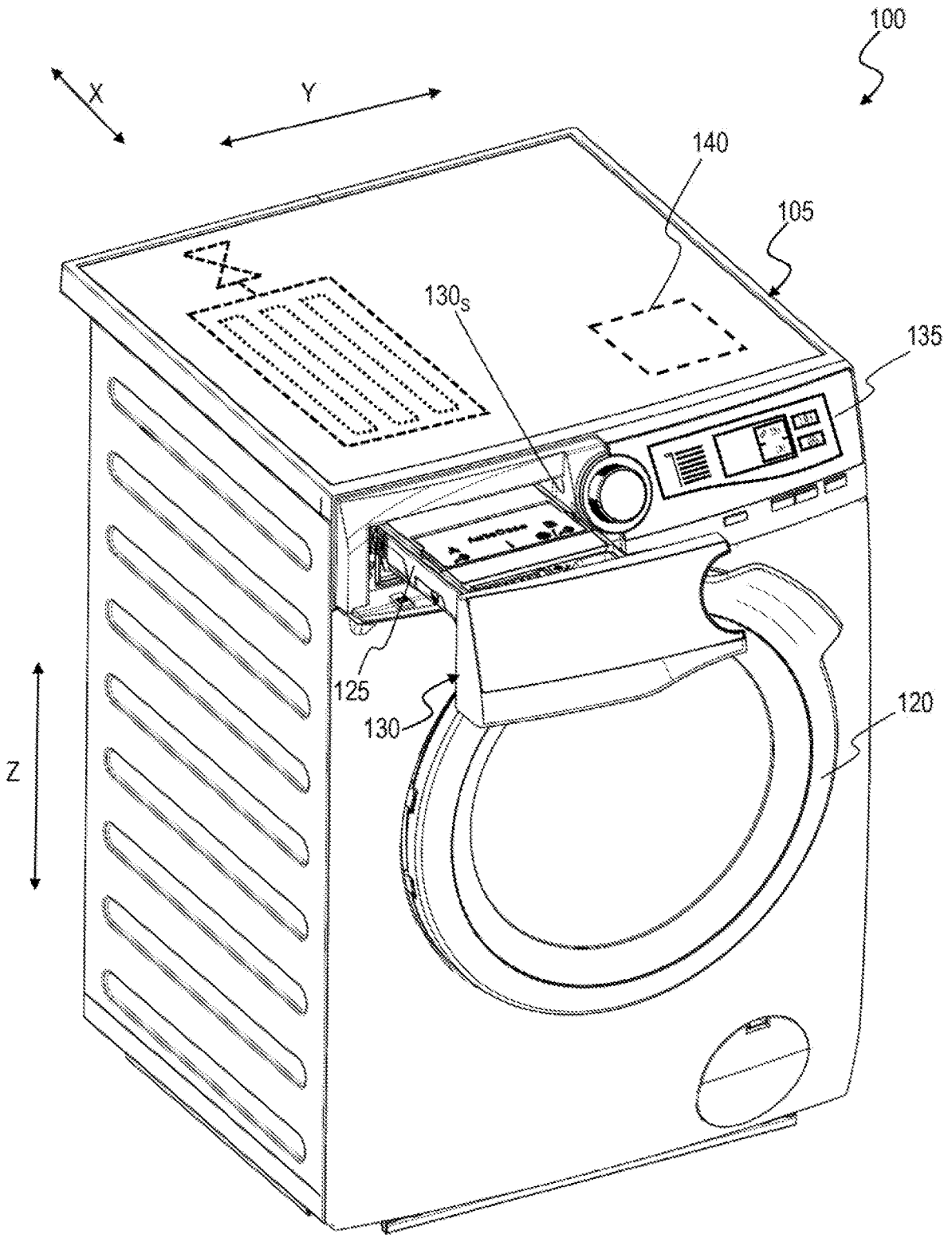
FIGS. 1A and 1B show perspective views of a laundry appliance according to an embodiment of the present invention.
Figure 1B:
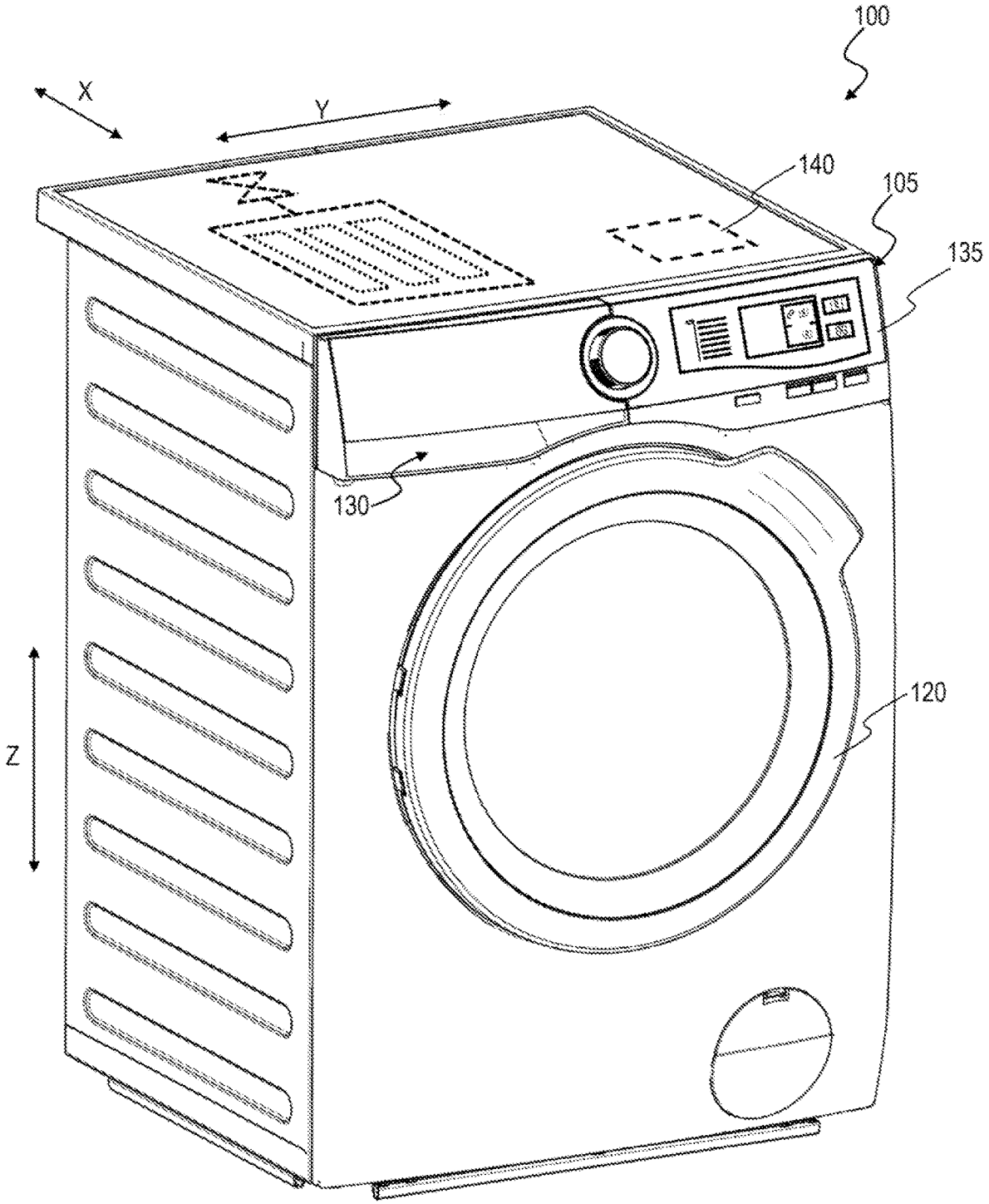

With reference to the drawings, FIGS. 1A and 1B show perspective views of a laundry appliance 100 according to an embodiment of the present invention.

According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined washers/dryers, i.e. washing machines also having laundry drying functions).

The laundry appliance 100 preferably comprises a number of electrical/electronic/mechanical/hydraulic components for the operation of the laundry appliance 100. However, for the sake of conciseness, only components of the laundry appliance 100 being relevant for the understanding of the present invention will be mentioned and discussed in the following.

The laundry appliance 100 preferably comprises a (e.g., parallepiped-shaped) cabinet 105, which preferably accommodates a treatment chamber (i.e., a laundry washing chamber in the example herein considered of a washing machine) for performing a treatment cycle on laundry load housed therein (e.g., a washing cycle or program in the example herein considered of a washing machine). As visible in FIG. 1C, which shows a side view of the laundry appliance 100 without a side wall of the cabinet 105, the treatment chamber preferably comprises a washing tub 110 and, within it, a rotatable washing basket or drum 115 adapted to contain the laundry load to be treated (e.g., washed).

A cabinet front has a loading opening providing an access to the drum 115 for loading/unloading the laundry load, a door 120 (shown in a closed position in FIGS. 1A-1C) being provided for sealably closing the loading opening during the operation of the laundry appliance 100.

The laundry appliance 100 preferably comprises a treatment agent dispensing apparatus 125 (only partially visible in FIG. 1A) for dispensing treatment agent towards the washing tub 110 to be used during the selected laundry treatment cycle.

The treatment agent dispensing apparatus 125 preferably comprises one or more compartments (hereinafter referred to as multi-dose compartments) each one adapted to contain multiple doses of a treatment agent (such as washing detergents, rinsing detergents, bleaches and softeners) for laundry treatment, i.e. for multiple laundry treatments (e.g., multiple washing cycles). In other words, the laundry appliance 100 is advantageously configured to implement an auto-dosing functionality in which, at each laundry treatment cycle (and, preferably, when the auto-dosing functionality is activated), an amount of treatment agent (also referred to as treatment agent dose) is automatically taken (e.g. by means of pump devices, as discussed in the following) from the multi-dose compartment(s).

In the exemplary considered embodiment, the multi-dose compartment(s) is(are) provided in a drawer 130 of the laundry appliance 100. The drawer 130 is preferably provided on a top part of the cabinet front of the laundry appliance 100, and is adapted to slide within a corresponding drawer seat $\mathbf{130}_S$, along a longitudinal or sliding direction X, between an extracted position (shown in FIG. 1A) and a retracted position (shown in FIG. 1B). The sliding direction X is for example parallel to a rest surface, such as the floor, on which the laundry appliance 100 preferably rests in operation (i.e., when it is installed in the user premises). In operation, the laundry appliance 100 rests on the rest surface, such as the floor, and uprightly extends from it along a vertical direction Z orthogonal to the sliding direction.

Figure 2:
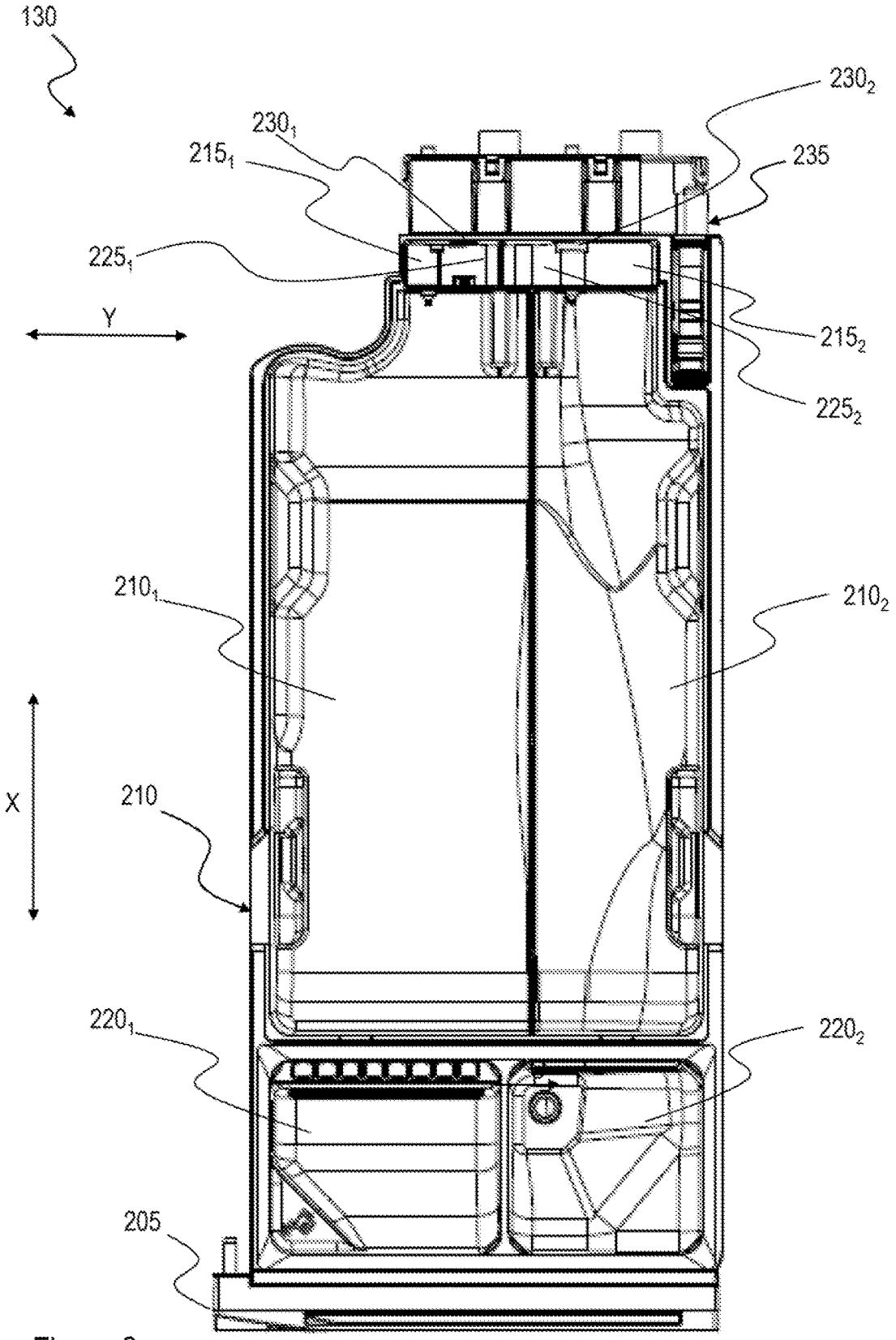
FIG. 2 shows a top view of a drawer of the laundry appliance according to an embodiment of the present invention.

With reference now also to FIG. 2, it shows a top view of the drawer 130 according to an embodiment of the present invention.

The drawer 130 preferably comprises a drawer handle 205 allowing the user to slidably move the drawer 130 between the extracted position and the retracted position when it is fitted in the drawer seat $\mathbf{130}_S$, and a drawer body 210 to which the drawer handle 205 is adapted to be mounted or coupled or connected (advantageously, in a removable or reversible way). When the laundry appliance 100 is installed and the drawer 130 is fitted in the drawer seat $\mathbf{130}_S$, the drawer handle 205 identifies, along the sliding direction X, a drawer front (which advantageously forms part of the cabinet front when the drawer 130 is in the retracted position).

In the exemplary considered embodiment, the drawer 130 (particularly, the drawer body 210) comprises two multi-dose compartments $\mathbf{210}_1,\mathbf{210}_2$, with the multi-dose compartment $\mathbf{210}_1$ that may for example be configurable to contain multiple doses of a treatment agent for washing treatment (e.g., a liquid washing detergent) and with the multi-dose compartment $\mathbf{210}_2$ that may for example be configurable to contain multiple doses of a treatment agent for softening treatment (e.g., a liquid softener)—although this should not be construed limitatively.

The drawer 130 (particularly, the drawer body 210) preferably comprises one or more (two, in the example at issue) channels $\mathbf{215}_1,\mathbf{215}_2$ associated with the multi-dose compartments $\mathbf{210}_1,\mathbf{210}_2$ (in the example herein considered, each channel $\mathbf{215}_1,\mathbf{215}_2$ is associated with a respective one of the multi-dose compartments $\mathbf{210}_1,\mathbf{210}_2$, the channel $\mathbf{215}_1$ being for example associated with the multi-dose compartment $\mathbf{210}_1$ and the channel $\mathbf{215}_2$ being for example associated with the multi-dose compartment $\mathbf{210}_2$). Each channel $\mathbf{215}_1,\mathbf{215}_2$ is preferably adapted to channel water and/or one or more treatment agent doses towards a region of the drawer seat $\mathbf{130}_S$ that allows a mixture between the water and the treatment agent dose(s) (hereinafter referred to as mixing region): the mixing region may for example be or comprise a bottom wall of the drawer seat $\mathbf{130}_S$ (not visible in the figures) in fluid communication with the washing tub 110.

As exemplary illustrated, the channels $\mathbf{215}_1,\mathbf{215}_2$ are preferably provided, along the sliding direction X, behind the multi-dose compartments $\mathbf{210}_1,\mathbf{210}_2$ (from the drawer front).

Advantageously, the channels $\mathbf{215}_1,\mathbf{215}_2$ (or at least one thereof) extend vertically or substantially vertically with respect to the rest surface (such as the floor) on which the laundry appliance 100 rests in operation (the channels $\mathbf{215}_1,\mathbf{215}_2$ thus extending substantially along the vertical direction Z), thereby allowing the treatment agent dose(s) (and advantageously water from a water feeding apparatus, as better discussed below) to fall towards the mixing region of the drawer seat $\mathbf{130}_S$ by gravity; in order to achieve it, each channel $\mathbf{215}_1,\mathbf{215}_2$ advantageously comprises a top channel input for receiving the water from the water feeding apparatus, and a bottom channel output facing the bottom wall of the drawer seat $\mathbf{130}_S$; in operation, the bottom channel outputs of the channels $\mathbf{215}_1,\mathbf{215}_2$ are arranged for delivering the water and the treatment agent dose(s) to the bottom wall of the drawer seat $\mathbf{130}_S$, and hence to the washing tub 110.

In the exemplary considered embodiment, the drawer 130 also comprises one or more (e.g. two) drawer compartments $\mathbf{220}_1,\mathbf{220}_2$, preferably provided between the drawer handle 205 and the multi-dose compartments $\mathbf{210}_1,\mathbf{210}_2$ along the sliding direction X, and each one adapted to contain a single dose of a respective treatment agent for performing a single treatment cycle (hereinafter referred to as mono-dose compartments $\mathbf{220}_1,\mathbf{220}_2$); just as an example, the mono-dose compartment $\mathbf{220}_1$ may be arranged to contain a single dose of a powder or liquid washing detergent, whereas the mono-dose compartment $\mathbf{220}_2$ may be arranged to contain a single dose of a powder or liquid or pearl softener.

The laundry appliance 100 also comprises pump devices (such as peristaltic pump devices, for example fixed-flow or variable-flow peristaltic pump devices) adapted to draw up treatment agent doses from the multi-dose compartments $\mathbf{210}_1,\mathbf{210}_2$, with each pump device that is preferably associated with a respective multi-dose compartment $\mathbf{210}_1,\mathbf{210}_2$. In the example herein considered of two multi-dose compartments $\mathbf{210}_1,\mathbf{210}_2$, two pump devices each one for drawing up treatment agent doses from a respective multi-dose compartment $\mathbf{210}_1,\mathbf{210}_2$ are provided. The pump devices are not visible in the figure, in that they are advantageously enclosed (at least partially) in a same case 235.

The pump devices are preferably provided behind the channels $\mathbf{215}_1,\mathbf{215}_2$ (from the drawer front) along the sliding direction X, and each one comprises a respective suction side in fluid communication (e.g., through a respective suction pipe $\mathbf{225}_1,\mathbf{225}_2$ of the drawer 130) with the multi-dose compartment $\mathbf{210}_1,\mathbf{210}_2$ for drawing up the treatment agent dose(s) therefrom, and a respective delivery side in fluid communication (e.g., through a respective delivery pipe $\mathbf{230}_1,\mathbf{230}_2$ of the drawer 130) with the channel $\mathbf{215}_1$, $\mathbf{215}_2$ for delivering the treatment agent dose(s) thereto.

As mentioned above, the laundry appliance 100 preferably comprises a water feeding apparatus WF for feeding water towards the washing tub 110 during a selected laundry treatment cycle. In the examplary considered embodiment, the water feeding apparatus WF advantageously forms a top of the drawer seat $\mathbf{130}_S$, thus allowing the water to be fed to the channels $\mathbf{215}_1,\mathbf{215}_2$ (and/or to the mono-dose compartments $\mathbf{220}_1,\mathbf{220}_2$, when provided) from above. The water feeding apparatus may for example comprise water conduits and electrically-controlled valves, illustrated in FIGS. 1A and 1B through schematical representations thereof.

Figure 1C:
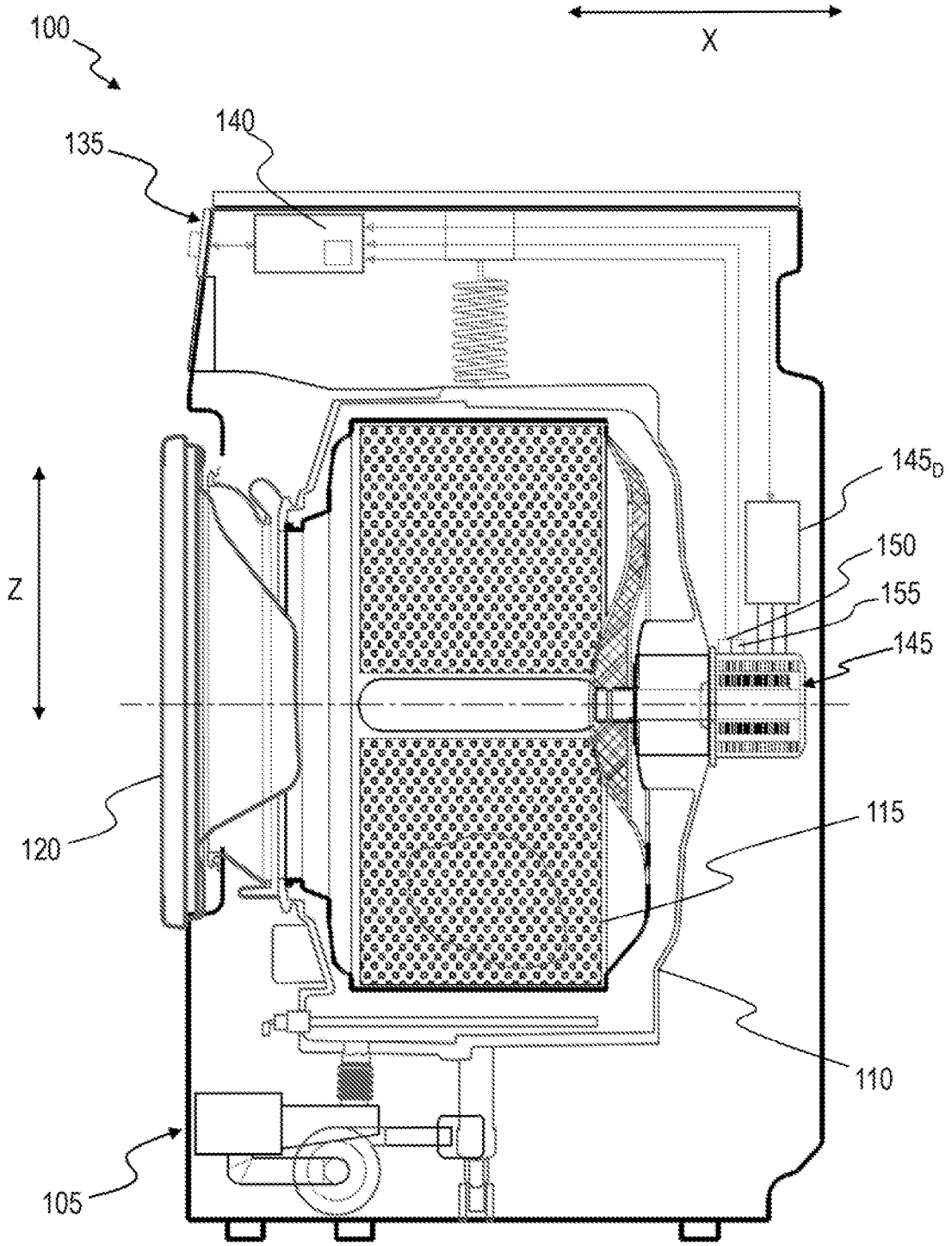
FIG. 1C shows a side view with partly removed parts of the laundry appliance of FIGS. 1A and 1B, according to an embodiment of the present invention.

Back to FIGS. 1A-1C, the laundry appliance 100 preferably comprises a user interface 135, the user interface 135 being preferably provided on the top part of the cabinet front, more preferably next to the drawer seat $\mathbf{130}_S$ along a transversal direction Y orthogonal to the longitudinal X and vertical Z directions.

The user interface 135 may for example comprise a display unit (such as a light emitting polymer display (LPD), a liquid crystal display, a thin film transistor-liquid crystal display, or an organic light-emitting diode display) for visually displaying one or more pieces of information (such as information about a status of one or more components of the laundry appliance 100 and/or information about a status of the treatment cycle, for example information about a residual time to the end of the ongoing treatment cycle, and/or information about a current phase of the ongoing treatment cycle, and/or selected parameters for the ongoing treatment cycle), and one or more control elements for allowing the user to select a treatment cycle and to control one or more operating parameters of the selected treatment cycle (such as, but not limited to, temperature, laundry load dirt level, spin speed, start time delay, drawer compartment selection, selection of the type of treatment agent). The control elements may for example comprise physical control elements, i.e. control elements whose activation/deactivation is associated with displacements of mechanical components (such as the rotary knob visible in FIGS. 1A-1C), and/or one or more virtual control elements, i.e. control elements whose activation/deactivation is associated with touch-sensitive electric components.

The laundry appliance 100 preferably comprises a control unit 140 for controlling the laundry appliance 100 according to instructions received by a user through the user interface 135 (the control unit 140 being visible in FIG. 1C and being also schematically illustrated as a dashed rectangle in FIGS. 1A and 1B). For example, the control unit 140 is configured to provide power and to interact with the electrical/electronic/mechanical/hydraulic components of the laundry appliance 100 in order to manage the execution of selected treatment cycles; for the purposes of the present disclosure, the control unit 140 is particularly arranged to determine an estimate of the amount of laundry load in the drum 115 and to cause water and treatment agent dose delivery accordingly (as better discussed in the following).

For the purposes of the present disclosure, the laundry appliance 100 preferably comprises an electric motor 145 (e.g. a three-phase electric motor or a bi-phase electric motor, such as a permanently excited synchronous motor or an asynchronous motor or a brushless direct current motor or an induction motor) adapted to rotate the drum 115 within the washing tub 110. The rotation of the drum 115 is achieved under the control of the control unit 140, and preferably through a motor driving apparatus $\mathbf{145}_D$ communicably coupled between the control unit 140 and the electric motor 145 (the motor driving apparatus $\mathbf{145}_D$ preferably comprising well known electric/electronic modules, not shown, such as a rectifying module for converting an AC power source into a DC driving voltage, a power inverter module for driving the electric motor 145 by means of the DC driving voltage, and a control module for controlling the power inverter module based on commands provided by the control unit 140).

Preferably, the electric motor 145 is adapted to rotate the drum 115 at variable speeds. More preferably, upon start of a selected treatment cycle and before any delivery of water to the laundry load (hereinafter referred to as preliminary phase of the selected treatment cycle), the electric motor 145 is adapted to rotate the drum 115 with a predefined speed profile (so as to allow the control unit 140 to determine an estimate of the amount of laundry load according to one or more parameters of the electric motor 145 being acquired during rotation of the drum 115 with the predefined speed profile, and to accordingly determine a treatment agent dose to be used during the selected treatment cycle, as better discussed in the following).

Figure 3:
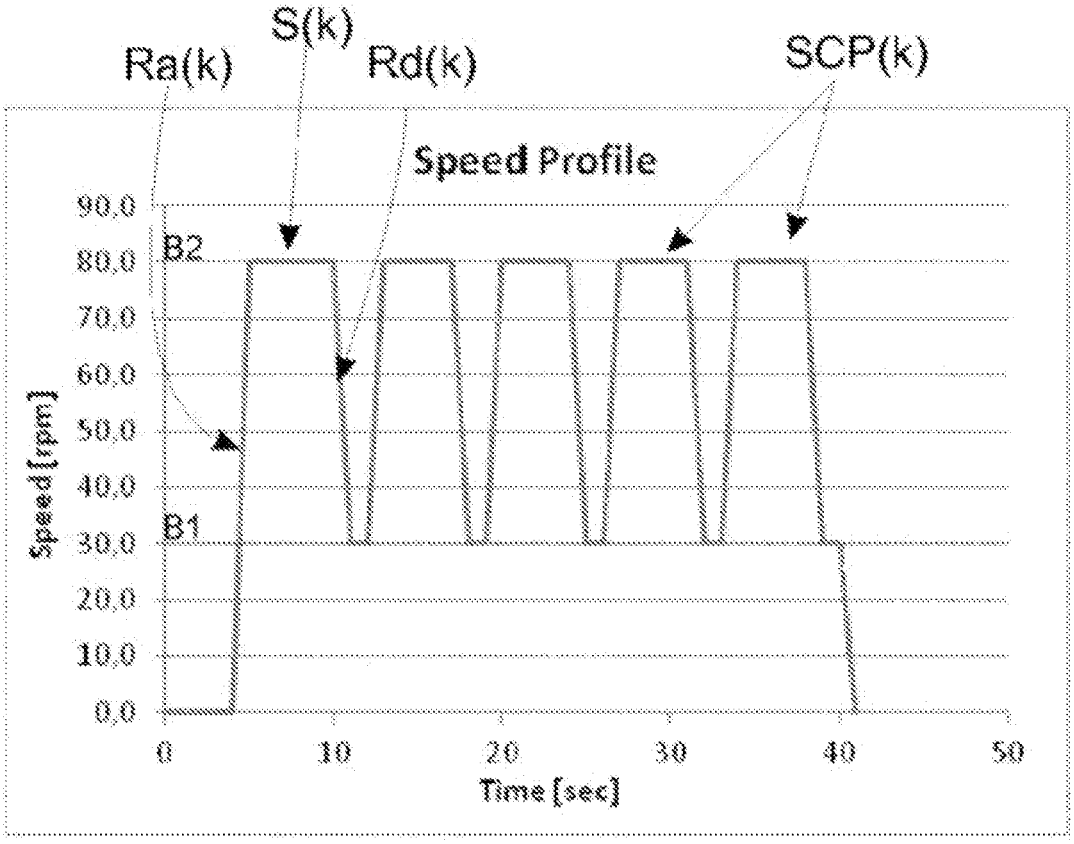
FIG. 3 shows an exemplary predefined speed profile with which a drum of the laundry appliance may be rotated at a preliminary phase of a selected treatment cycle according to an embodiment of the present invention.

In the exemplary considered embodiment, as visible in FIG. 3, the predefined speed profile comprises a ramp speed profile portion (or positive ramp speed profile portion) Ra(k) in which the drum 115 is accelerated from a first (low) rotational speed B1 (e.g. in a rotational speed range from about 25 to 35 RPM, preferably 30 RPM), to a second (high) rotational speed B2 higher than the low rotational speed B1 (e.g. in a rotational speed range from about 75 to 85 RPM, preferably 80 RPM), and a constant speed profile portion S(k) in which the drum 115 is constantly rotated at the high rotational speed B2 for a predefined duration (the predefined duration being for example set according to the time spent by the drum 115 to complete a prefixed number of revolutions at the high rotational speed B2).

More preferably, as illustrated in FIG. 3, the predefined speed profile comprises a plurality K of drum speed commutations SCP(k) (k=1, 2, . . . , K, with K=5 in the example at issue, K being conveniently chosen according to specific design options) each one comprising the positive ramp Ra(k) and constant S(k) speed profile portions. Even more preferably, as illustrated in FIG. 3, the predefined speed profile also comprises, preferably for each drum speed commutations SCP(k), a further ramp speed profile portion (or negative ramp speed profile portion) Rd(k) in which the drum 115 is decelerated from the second rotational speed B2 to the first rotational speed B1—advantageously, the constant speed profile portion S(k) immediately following the positive ramp speed profile portion Ra(k) and immediately preceding the negative ramp speed profile portion Rd(k).

As should be readily understood, and as also illustrated in FIG. 3, the first positive ramp speed profile portion Ra(1) (i.e., the positive ramp speed profile portion of the first drum speed commutation SCP(1)) also comprises an initial positive ramp speed profile portion in which the drum 115 is accelerated from the zero rotational speed to the rotational speed B1, and the last negative ramp speed profile portion Rd(5) (i.e., the negative ramp speed profile portion of the last drum speed commutation SCP(5)) also comprises a final negative ramp speed profile portion in which the drum 115 is decelerated from the rotational speed B1 to the zero rotational speed.

In order to allow the control unit 140 to control rotation of the electric motor 145 at variable speeds, such as with the predefined speed profile, the laundry appliance 100 advantageously comprises one or more speed sensors, such as the speed sensor 150 visible in FIG. 1C, for providing a signal indicative of a rotational speed of the drum 115.

As should be understood, although in the foregoing explicit reference to the rotational speed of the drum 115 is made for discussing the predefined speed profile and the signal provided by the speed sensor 150, similar considerations apply when the speed of the electric motor 145 is considered (in which case the speed sensor 150 may advantageously be configured to provide a signal indicative of the speed of the electric motor 145 and the predefined speed profile may be referred to the speed of the electric motor 145 as sensed by the speed sensor 150, or to the rotational speed of the drum 115 derived from it).

As mentioned above, during the preliminary phase of the selected treatment cycle, the control unit 140 is configured to determine an estimate of the amount of laundry load according to one or more parameters of the electric motor 145 being acquired during rotation of the drum 115 with the predefined speed profile. According to an embodiment of the present invention, said one or more parameters of the electric motor 145 comprise a torque of the electric motor 145.

In order to acquire the torque of the electric motor 145 during rotation of the drum 115 with the predefined speed profile, the laundry appliance 100 advantageously comprises one or more motor torque sensors, such as the motor torque sensor 155 visible in FIG. 1C, which is configured to provide a signal indicative of the torque generated by the electric motor 145; as should be understood, the torque generated by the electric motor 145 substantially corresponds to the torque applied to the drum 115 by the electric motor 145, and depends on an inertia of the drum 115 and on the laundry load within the drum 115.

According to alternative embodiments of the present invention, the torque of the electric motor 145 is determined according to one or more output signals of the electric motor 145 (in which case the motor torque sensor 155 may advantageously be omitted); just as an example, the torque of the electric motor 145 may be determined according to one or more output signals of the electric motor 145, such as an output current signal from the electric motor 145 indicative of the electric motor power.

Figure 4:
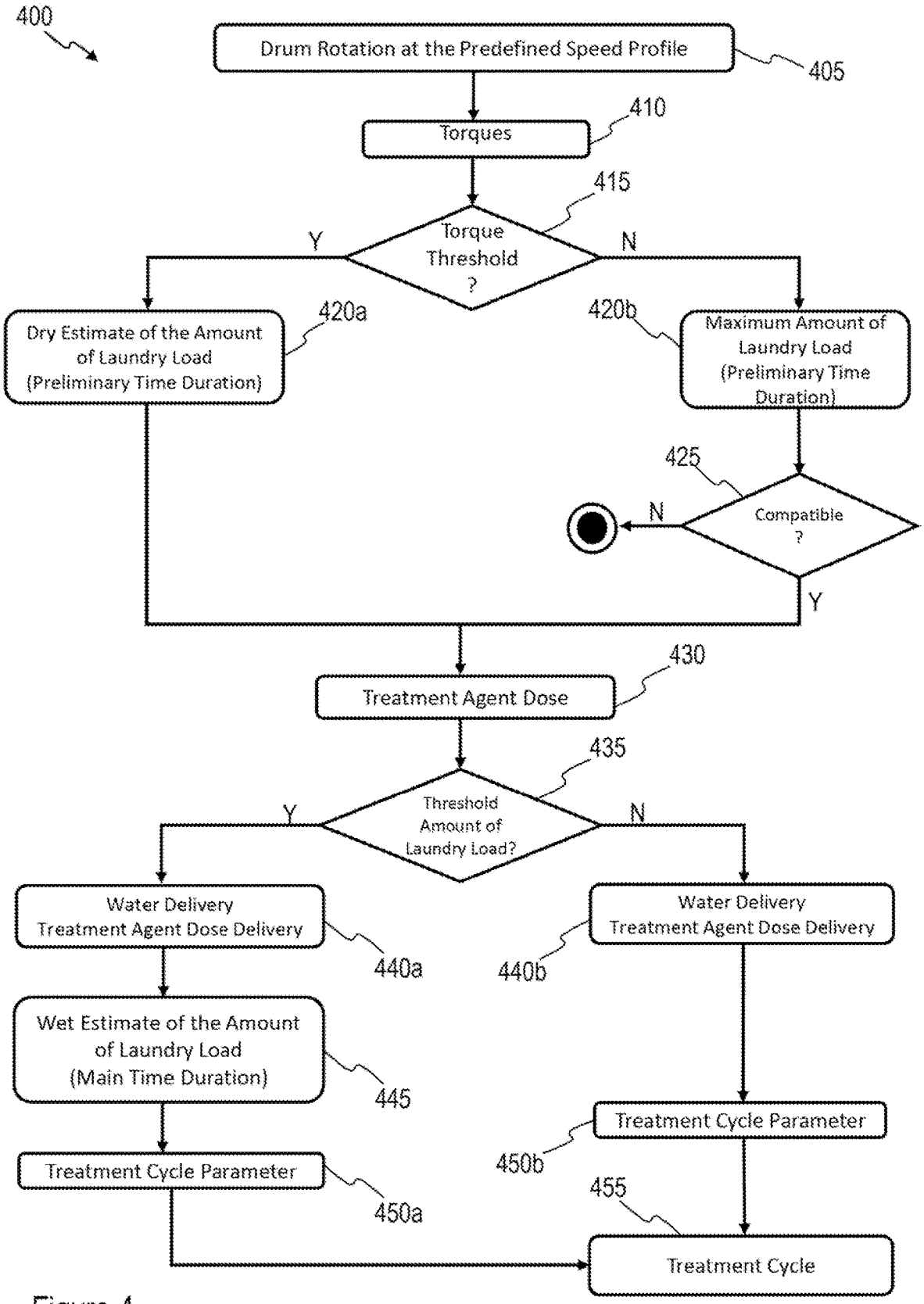
FIG. 4 shows an activity diagram of a method for performing a selected treatment cycle according to an embodiment of the present invention.

With reference to FIG. 4, it shows an activity diagram of a method 400 carried out by the laundry appliance 100, particularly under the control of the control unit 140, for performing the selected treatment cycle according to an embodiment of the present invention. As mentioned above, the selected treatment cycle comprises a preliminary phase (see nodes 405-430 of the activity diagram) aimed at determining an estimate of the amount of laundry load contained in the drum 115 and, accordingly, a treatment agent dose to be used during the selected treatment cycle, and a main phase (see nodes 435-455 of the activity diagram) aimed at performing the selected treatment cycle according to the determined treatment agent dose.

Upon selection of the treatment cycle by the user (e.g., through the user interface 135), the control unit 140 is preferably configured to:

- control the electric motor 145 to cause the drum 115 to be rotated with the predefined speed profile (as discussed above, the predefined speed profile portion comprising at least one positive ramp speed profile portion Ra(k) in which the drum 115 is accelerated from the low rotational speed B1 to the high rotational speed B2, and at least one constant speed profile portion S(k) in which the drum 115 is constantly rotated at the high rotational speed B2)—action node 405;
- acquire one or more parameters (such as a torque) of the electric motor 145 during rotation of the drum 115 with the predefined speed profile—action node 410;
- determine, and preferably display through the display unit of the user interface 135, an estimate of the amount of laundry load according to said one or more parameters of the electric motor 145 being acquired during rotation of the drum 115 with the predefined speed profile—action node 420*a* or action node 420*b*. As mentioned above, the estimate of the amount of laundry load at action node is determined at action node 420*a* or 420*b* before any delivery of water, whereby it will be also referred to as dry estimate of the amount of laundry load (especially for distinguishing it from a wet estimate of the amount of laundry load, as discussed in the following); and
- according to said estimate of the amount of laundry load, determine a treatment agent dose to be used during the selected laundry treatment cycle—action node 430.

As mentioned above, the nodes 405-430 take place during the preliminary phase of the treatment cycle, i.e. before any delivery of water to the laundry load (and, preferably, after a draining procedure in which a drain apparatus of the laundry appliance 100, not shown, drains possible remaining liquid/water).

Preferably, the acquisition of the torque of the electric motor 145 (action node 410) is performed by the control unit 140 (in cooperation with the motor torque sensor 155) by determining one or more torques of the electric motor 145 during rotation of the drum 115 with the ramp speed profile portion Ra(k) (hereinafter referred to as RSPP ("ramp speed profile portion") torques), and one or more torques of the electric motor 145 during rotation of the drum 115 with the constant speed profile portion S(k) (hereinafter referred to as CSPP ("constant speed profile portion") torques).

More preferably, the acquisition of the torque of the electric motor 145 (action node 410) is performed by the control unit 140 by determining a plurality of RSPP torques according to a respective sample time Δta during rotation of the drum 115 with the ramp speed profile portion Ra(k) (hereinafter referred to as RSPP ("ramp speed profile portion") sample time Δta), and a plurality of CSPP torques according to a respective sample time Δtb during rotation of the drum 115 with the constant speed profile portion S(k) (hereinafter referred to as CSPP ("constant speed profile portion") sample time Δtb).

The RSPP Δta and CSPP Δtb sample times are advantageously a multiple of a motor control loop (which may be of the order of $1*10^{-3}$ seconds when the frequency of the AC power source is 50 Hz), so that, as experimentally ascertained by the Applicant, the accuracy of the estimate of the amount of laundry load is increased and the torque acquisition is easier to manage. In this respect, the RSPP sample time Δta may for example range from about $0.1*10^{-3}$ seconds to about $20*10^{-3}$ seconds, the RSPP sample time Δta being advantageously of the order of $10*10^{-3}$ seconds, whereas the CSPP sample time Δtb may for example range from about $0.1*10^{-3}$ seconds to about $50*10^{-3}$ seconds, the CSPP sample time Δtb being advantageously of the order of $10*10^{-3}$ seconds.

Preferably, the determination of the estimate of the amount of laundry load according to the RSPP and CSPP torques of the electric motor 145 being acquired during rotation of the drum 115 with the predefined speed profile is performed according to an integral function ($\text{Torque}_{int}$), over said RSPP sample time Δta, with respect to the plurality of RSPP torques subtracted by an average CSPP torque among the plurality of CSPP torques, i.e.:

$$\text{Torque}_{int} = \left[\sum_{i=1}^{N}(Ti - TU)\right] * \Delta ta$$

$$TU = \left(\frac{1}{M}\right) * \sum_{j=1}^{M} Tj$$

wherein Ti represents the i-th RSPP torque among the plurality N of RSPP torques, and Tj represents the j-th CSPP torque among the plurality M of CSPP torques; TU (which, in the example at issue, is calculated as an arithmetic mean) instead represents the average CSPP torque, and is substantially indicative of the torque needed to contrast friction of the laundry appliance, i.e. both system friction (due to, for example, to stiffness, suspension, aging, bearings, temperature, and belt tension differently affecting each laundry appliance) and laundry load friction (due, for example, to friction of the laundry load on the door, and depending on the amount of laundry load and its distribution in the drum).

In the example at issue in which, as illustrated in FIG. 3, the predefined speed profile comprises a plurality K of (sequential) drum speed commutations SCP(k) each one comprising the positive ramp speed profile portion Ra(k), the constant speed profile portion S(k) and, preferably, the negative ramp speed profile portion Rd(k), the determination of the estimate of the amount of laundry load according to the RSPP and CSPP torques of the electric motor 145 being acquired during rotation of the drum 115 with the predefined speed profile is advantageously performed according to a plurality K of integral functions $\text{Torque}_{int}(k)$ (each one associated with a respective k-th drum speed commutation SCP(k)) and according to a difference (hereinafter, differential torque $\text{Torque}_{diff}(k)$) between each integral function $\text{Torque}_{int}(k)$ and an average integral function among the plurality K of integral functions $\text{Torque}_{int}(k)$, i.e.:

$$\text{Torque}_{int}(k) = \left[\sum_{i=1}^{N}(Ti(k) - TU(k))\right] * \Delta ta$$

$$TU(k) = \left(\frac{1}{M}\right) * \sum_{j=1}^{M} Tj(k)$$

$$\text{Torque}_{diff}(k) = \text{Torque}_{int}(k) - \frac{1}{K}\left[\sum_{k=1}^{K}\text{Torque}_{int}(k)\right]$$

wherein, similarly to the above, Ti(k) represents the i-th RSPP torque among the plurality N of RSPP torques acquired during the k-th drum speed commutation SCP(k), Tj(k) represents the j-th CSPP torque among the plurality M of CSPP torques acquired during the k-th drum speed commutation SCP(k), and TU(k) represents the average CSPP torque TU(k) among the plurality of CSPP torques acquired during the k-th drum speed commutation SCP(k).

According to a preferred embodiment of the present invention, the control unit 140 is configured to determine the estimate of the amount of laundry load (action node 420*a*) by applying to the integral function $\text{Torque}_{int}$ (k=1) or to the differential torque $\text{Torque}_{diff}(k)$ (k>1) one or more parameters experimentally calculated by the Applicant (and preferably stored in a proper memory location of the control unit 140, not shown), as disclosed for example in EP3162943A1, and hence to determine (action node 430) the treatment agent dose accordingly (i.e., according to the estimate of the amount of laundry load).

As conceptually represented in FIG. 4 by the decision node 415, the estimate of the amount of laundry load is advantageously determined as discussed for action node 420*a* if (exit branch Y of the decision node 415) the RSPP and CSPP torques (or at least a relevant number thereof) are below respective torque thresholds (hereinafter referred to as RSPP and CSPP torque thresholds, respectively); this condition is advantageously indicative that the amount of laundry load is expected not to exceed a maximum amount of laundry load.

According to the preferred embodiment herein considered, if (exit branch N of the decision node 415), the RSPP and CSPP torques (or at least a relevant number thereof) are above the respective RSPP and CSPP torque thresholds, the control unit 140 is advantageously configured to set the selected treatment cycle for the maximum amount of laundry load accepted by the laundry appliance 100 (action node 420*b*), and hence to determine (action node 430) the treatment agent dose accordingly (i.e., according to the maximum amount of laundry load).

Preferably, the determination by the control unit 140 of the treatment agent dose to be used during the selected treatment cycle (action node 430) may also be based on a predefined treatment agent dose (e.g., a default or minimum treatment agent dose preferably stored in a proper memory location of the control unit 140); the predefined treatment agent dose may for example be determined by the control unit 140 according at least one property of the treatment agent (such as chemical properties or compositions or active ingredients) automatically recognized by the laundry appliance 100 (e.g., through one or more dedicated sensors thereof, not shown), or manually input by a user (e.g., through the user interface 135).

As conceptually represented in FIG. 4 by the decision node 425, the treatment agent dose is determined at action node 430 based on the maximum amount of laundry load accepted by the laundry appliance 100 only if (exit branch Y of the decision node 425) such a maximum amount of laundry load accepted by the laundry appliance 100 is compatible with the selected treatment cycle. According to the preferred embodiment herein considered, if (exit branch N of the decision node 425), the maximum amount of laundry load accepted by the laundry appliance 100 is not compatible with the selected treatment cycle, the treatment cycle is not started, and/or a corresponding warning signal is advantageously emitted by the laundry appliance 100.

In alternative embodiments of the present invention, if (exit branch N of the decision node 415), the RSPP and CSPP torques (or at least a relevant number thereof) are above the respective RSPP and CSPP torque thresholds, the control unit 140 is advantageously configured to set the selected treatment cycle for the maximum amount of laundry load accepted by the laundry appliance 100 for that treatment cycle (action node 420*b*), and hence to determine (action node 430) the treatment agent dose accordingly (i.e., according to the maximum amount of laundry load accepted for that treatment cycle), in which case the decision node 425 may therefore be omitted.

As mentioned above, after having determined (action node 430) the treatment agent dose to be used during the selected treatment cycle, the control unit 140 is advantageously configured to cause delivery of water and of the determined treatment agent dose to the laundry load (action node 440*a* or action node 440*b*). Without losing generality, the control unit 140 may be configured to cause the delivery of the determined treatment agent dose after or together with the delivery of water, preferably after or together with the delivery of a partial amount of water (the partial amount of water being partial with respect to an overall amount required for the execution of the selected treatment cycle).

In the exemplary considered embodiment discussed here below, such a delivery of water comprises (action node 440*a*) the delivery of the (partial) amount of water for allowing to determine a further estimate of the amount of laundry load, or (action node 440*b*) the delivery of the (partial) amount of water for allowing the determined treatment agent dose to be flushed and directed towards the treatment chamber: in both cases, the delivery of the treatment agent dose may be performed after or together with a predetermined step of said delivery of the (partial) amount of water (as discussed below).

Preferably, although not necessarily, the control unit 140 is configured to determine a further estimate of the amount of laundry load (action node 445) if (exit branch Y of the decision node 435) the estimate of the amount of laundry load determined at action node 420*a* or 420*b* is above a threshold amount of laundry load, the threshold amount of laundry load being for example comprised in a range between about from ⅕ to ⅗ of the maximum amount of laundry load and advantageously allowing to discern between "heavy" and "light" amounts of laundry load.

As illustrated, the check (comparison) at the check node 435 is advantageously performed regardless of the estimate of the amount of laundry load is determined at action node 420*a* or at action node 420*b*): the check at decision node 435 could in principle be redundant when the estimate of the amount of laundry load is determined at action node 420*b* by setting it at the maximum amount of laundry load accepted by the laundry appliance 100 (indeed, in this case, the estimate of the amount of laundry load is supposed to be always above the threshold amount of laundry load), but it could be not redundant when, as in the alternative embodiments of the present invention discussed above, the estimate of the amount of laundry load is determined at action node 420*b* by setting at the maximum amount of laundry load accepted by the laundry appliance 100 for that treatment cycle (indeed, in this case, the estimate of the amount of laundry load may be above or below the threshold amount of laundry load according to a high or low maximum amount of laundry load accepted by the laundry appliance 100 for that treatment cycle).

According to the preferred embodiment herein considered, the further estimate of the amount of laundry load is based on water absorption by the laundry load, whereby it will be also referred to as wet estimate of the amount of laundry load (as opposed to the dry estimate of the amount of laundry load determined at action node 420*a* or 420*b* before any delivery of water).

In order to determine the wet estimate of the amount of laundry load, the control unit 140 may advantageously be configured to perform the delivery of water by (action node 440*a*) iteratively causing the delivery of a predetermined amount of water, waiting a predetermined time interval, determining a water level variation in the drum 115 within the predetermined time interval, and stopping water delivery if the water level variation is below or equal to a threshold water level variation, and to determine the wet estimate of the amount of laundry load (action node 445) based on water absorption by the laundry load according to the amount of water added in the drum up to the stopping of water delivery—see, for example, EP3241938 for a more thorough discussion of such a wet estimate of the amount of laundry load.

In this case the delivery of the treatment agent dose may for example be performed (action node 440*a*) after or together with the delivery of the predetermined amount of water taking place at a predefined iteration.

According to an advantageous embodiment of the present invention, the control unit 140 is configured to determine the wet estimate of the amount of laundry load also based on at least one among water hardness, dirt level of the laundry load, color of the laundry load and fabric type of the laundry load.

Back to the decision node 435, if the estimate of the amount of laundry load determined at action node 420*a* or 420*b* is below the threshold amount of laundry load (exit branch N of the decision node 435), no wet estimate of the amount of laundry load is determined and the control unit 140 is preferably configured to control the delivery of the treatment agent dose after or together with a predetermined step of the delivery of water (action node 440*b*), more preferably after or together with the delivery of at least part of the water intended to flush the determined treatment agent dose (e.g., through the channels $\mathbf{215}_1$,$\mathbf{215}_2$ and the mixing region) and direct it towards the treatment chamber.

Preferably, as illustrated, the control unit 140 is further configured to determine at least one parameter of the selected treatment cycle (such as one or more among time duration of the selected treatment cycle and amount of water to be delivered during the selected treatment cycle), hereinafter referred to as treatment cycle parameter(s), based on the wet estimate of the amount of laundry load (action node 450*a*) or based on the dry estimate of the amount of laundry load (action node 450*b*), whereby the selected treatment cycle is executed (under the control of the control unit 140) based on the determined treatment cycle parameter(s) (action node 455).

Particularly:

when the dry estimate of the amount of laundry load determined at action node 420*a* or 420*b* is above the threshold amount of laundry load (exit branch Y of the decision node 435), i.e. relatively high amount of laundry load, and the wet estimate of the amount of laundry load is determined at action node 445, the control unit 140 is advantageously configured to determine the treatment cycle parameter(s) based on the wet estimate of the amount of laundry load (action node 450*a*), advantageously without changing the treatment agent dose determined during the preliminary phase of the selected treatment cycle (i.e., with the wet estimate of the amount of laundry load and the treatment cycle parameter(s) that do not affect the treatment agent dose determined at action node 430). More advantageously, in such a condition the treatment cycle parameter(s) is(are) set to optimized values (as opposed to standard values set by default for the treatment cycle parameter (s) when a relatively low amount of laundry load is determined, as discussed below), in that the standard values of the treatment cycle parameter(s) could negatively affect the treatment of a relatively high amount of laundry load;

when the dry estimate of the amount of laundry load determined at action node 420*a* or 420*b* is below the threshold amount of laundry load (exit branch N of the decision node 435), i.e. relatively light amount of laundry load, and hence no wet estimate of the amount of laundry load is determined, the control unit 140 is advantageously configured to determine the treatment cycle parameter(s) based on the dry estimate of the amount of laundry load (action node 450*b*)—similarly to the above, the treatment agent dose determined at action node 430 being still not affected by the treatment agent parameter(s) (particularly, the time duration of the selected treatment cycle and the amount of water to be delivered during the selected treatment cycle). More advantageously, in such a condition the treatment cycle parameter(s) is(are) set to the standard values, in that the standard values of the treatment cycle parameter(s) allow (i.e., they are typically selected to allow) a correct treatment of a relatively low amount of laundry load.

Thanks to differentiated determination of the treatment cycle parameter(s) (action node 450*a* or action node 450*b*), the scenario is avoided that values of the treatment cycle parameter(s) being optimal for relatively high amounts of laundry load are unnecessarily set also for relatively low amounts of laundry load, which would cause an excessive waste of resources and/or of time.

According to an advantageous embodiment of the present invention, the determination of the treatment cycle parameter(s) based on the wet estimate of the amount of laundry load (action node 450*a*) and/or the determination of the of the treatment cycle parameter(s) based on the dry estimate of the amount of laundry load (action node 450*b*) may further be based on at least one among water hardness, dirt level of the laundry load, color of the laundry load and fabric type of the laundry load.

As mentioned above, the treatment cycle parameter(s) determined at action node 450*a* or 450*b* may comprise the time duration of the selected treatment cycle.

According to an embodiment of the present invention, the time duration of the selected treatment cycle comprises a time duration determined by the control unit 140 according to the dry estimate of the amount of laundry load. The determination of such a time duration is preferably performed within the preliminary phase of the selected treatment cycle (therefore it will be referred to as preliminary time duration, in order to distinguish it from a main time duration preferably, although not necessarily, determined during the main phase of the selected treatment cycle), and after the determination of the dry estimate of the amount of laundry load (in the exemplary illustrated activity diagram, the determination of the preliminary time duration is considered to be performed contextually with (i.e., immediately after) the determination of the dry estimate of the amount of laundry load, thus it has been included in action nodes 420*a* and 420*b*). Similarly to the above, the treatment agent dose determined at action node 430 is advantageously not affected by the preliminary time duration.

According to an embodiment of the present invention, the time duration of the selected treatment cycle further comprises a time duration determined by the control unit 140 according to the wet estimate of the amount of laundry load. The determination of such a time duration is preferably performed within the main phase of the selected treatment cycle (therefore it will be referred to as main time duration, in order to distinguish it from the preliminary time duration), and after the determination of the wet estimate of the amount of laundry load (in the exemplary illustrated activity diagram, the determination of the main time duration is considered to be performed contextually with (i.e., immediately after) the determination of the wet estimate of the amount of laundry load, thus it has been included in action node 445). Similarly to the above, the treatment agent dose determined at action node 430 is advantageously not affected by the main time duration.

Therefore, according to the exemplary considered embodiment of the present invention, when the dry estimate of the amount of laundry load determined at action node 420*a* or 420*b* is above the threshold amount of laundry load (exit branch Y of the decision node 435), i.e. relatively high amount of laundry load, and the wet estimate of the amount of laundry load is determined at action node 445, the control unit 140 is advantageously configured to determine, and preferably display, the main time duration of the selected treatment cycle, with the main time duration that advantageously replaces the preliminary time duration determined during the preliminary phase of the selected treatment cycle.

The main time duration of the selected treatment cycle is preferably based on the wet estimate of the amount of laundry load, more preferably it is determined independently from the dry estimate of the amount of laundry load. However, according to alternative embodiments of the present invention, the main time duration of the selected treatment cycle may be based both on the wet estimate of the amount of laundry load and on the dry estimate of the amount of laundry load, the main time duration being for example a refined version of the preliminary time duration (in which case the wet estimate of the amount of laundry load may for example be exploited to determine a proper corrective factor to be applied to the preliminary time duration in order to obtain the main time duration).

Preferably, when the dry estimate of the amount of laundry load determined at action node 420*a* or 420*b* is below the threshold amount of laundry load (exit branch N of the decision node 435), i.e. relatively low amount of laundry load, and no wet estimate of the amount of laundry load is determined, no main time duration is determined by the control unit 140, with the control unit 140 that may be still configured to gradually update the preliminary time duration while executing the treatment cycle.

As should be understood, the fact that the treatment agent dose determined at action node 430 is not affected by the wet estimate of the amount of laundry load, allows drawing up from the multi-dose compartments $\mathbf{210}_1$,$\mathbf{210}_2$ and dispensing to the treatment chamber all the treatment agent dose at once, i.e., in a same phase advantageously at the very first phase(s) of the treatment cycle. This strongly improves the efficiency of the laundry treatment, in that no belatedly interaction of the treatment agent with the laundry load takes place, nor partial amounts of treatment agent are used during some treatment cycle phases.

Moreover, dispensing to the treatment chamber all the treatment agent dose at once also avoids, in a single treatment cycle, multiple activations and deactivations of the pump devices associated with the multi-dose compartments $\mathbf{210}_1$,$\mathbf{210}_2$, which strongly improves the reliability of the pump devices.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof, on the contrary, well known features may have been omitted or simplified in order not to obscure the description with unnecessary particulars.

The invention claimed is:

1. A laundry treatment appliance comprising:

a rotatable drum configured to house a laundry load to be treated;

an electric motor configured to rotate the rotatable drum;

at least one compartment configured to contain multiple doses of a treatment agent for laundry treatment, and a control unit configured to:

(i) before any delivery of water to the laundry load during a selected laundry treatment cycle:

control the electric motor to rotate the rotatable drum with a predefined speed profile comprising a ramp speed profile portion in which the rotatable drum is accelerated from a first rotational speed to a second rotational speed higher than the first rotational speed, and a constant speed profile portion in which the rotatable drum is constantly rotated at the second rotational speed;

determine an estimate of the amount of laundry load according to one or more parameters of the electric motor being acquired during rotation of the rotatable drum with the predefined speed profile;

according to the estimate of the amount of laundry load, determine a treatment agent dose to be used during the selected laundry treatment cycle, and (ii) after having determined the treatment agent dose to be used during the selected laundry treatment cycle:

deliver water to the laundry load, and deliver the determined treatment agent dose to the laundry load, wherein the control unit is further configured to:

upon determining the estimate of the amount of laundry load is above a threshold amount of laundry load, determine a further estimate of the amount of laundry load based on water absorption by the laundry load and determine at least one parameter of the selected laundry treatment cycle based on the further estimate of the amount of laundry load; and upon determining the estimate of the amount of laundry load is below the threshold amount of laundry load, determine the at least one parameter of the selected laundry treatment cycle based on the estimate of the amount of laundry load.

2. The laundry treatment appliance according to claim 1, wherein the control unit is configured to deliver the determined treatment agent dose and deliver the water at least partially at the same time.

3. The laundry treatment appliance according to claim 1, wherein the control unit is configured to deliver the determined treatment agent dose after the delivery of at least a portion of the water.

4. The laundry treatment appliance according to claim 1, wherein the one or more parameters of the electric motor comprises a torque of the electric motor.

5. The laundry treatment appliance according to claim 1, wherein the control unit is configured to determine a first torque and a second torque of the electric motor during rotation of the rotatable drum with the ramp and constant speed profile portions, respectively, and to determine the estimate of the amount of laundry load according to the first torque and the second torque.

6. The laundry treatment appliance according to claim 5, wherein the control unit is configured to determine the first torque and the second torque by determining a plurality of first torque values according to a respective first sample time during rotation of the rotatable drum with the ramp speed profile portion and a plurality of second torque values according to a respective second sample time during rotation of the rotatable drum with the constant speed profile portion, and wherein the control unit is configured to determine the estimate of the amount of laundry load according to an integral function, over the first sample time, with respect to the plurality of first torque values subtracted by an average torque among the plurality of second torque values.

7. The laundry treatment appliance according to claim 6, wherein the predefined speed profile comprises a plurality of drum speed commutations each one comprising the ramp and constant speed profile portions, and wherein the control unit is configured to calculate the integral function for each drum speed commutation thereby obtaining a plurality of integral functions, the control unit being configured to determine the estimate of the amount of laundry load according to a difference between each integral function and an average integral function among the plurality of integral functions.

8. The laundry treatment appliance according to claim 1, wherein the predefined speed profile further comprises a further ramp speed profile portion in which the rotatable drum is decelerated from the second rotational speed to the first rotational speed, the constant speed profile portion immediately following the ramp speed profile portion and immediately preceding the further ramp speed profile portion.

9. The laundry treatment appliance according to claim 1, wherein the control unit is further configured to, upon determining the estimate of the amount of laundry load is above the threshold amount of laundry load, the delivery of water to the laundry load by iteratively causing the delivery of a predetermined amount of water, waiting a predetermined time interval, determining a water level variation in the rotatable drum within the predetermined time interval, and stopping water delivery if the water level variation is below or equal to a threshold water level variation, the control unit being configured to determine the further estimate of the amount of laundry load based on water absorption by the laundry load according to the amount of water added in the drum up to the stopping of water delivery.

10. The laundry treatment appliance according to claim 1, wherein the at least one parameter of the selected laundry treatment cycle comprises at least one among time duration of the selected laundry treatment cycle and amount of water to be delivered during the selected laundry treatment cycle.

11. The laundry treatment appliance according to claim 1, wherein, according to the estimate of the amount of laundry load, the control unit is further configured to determine a first time duration of the selected laundry treatment cycle, and wherein the control unit is configured to, upon determining the estimate of the amount of laundry load is above the threshold amount of laundry load, a second time duration of the selected laundry treatment cycle based on the further estimate of the amount of laundry load.

12. The laundry treatment appliance according to claim 11, wherein the control unit is configured to, upon determining the estimate of the amount of laundry load is below the threshold amount of laundry load, gradually update the first time duration while executing the laundry treatment cycle, without determining the second time duration.

13. The laundry treatment appliance according to claim 5, wherein the control unit is further configured to compare at least one among the first and second torques with respective first and second threshold torques, and, upon determining that the at least one among the first and second torques is below the respective first and second threshold torques, the estimate of the amount of laundry load from the first and second torques.

14. The laundry treatment appliance according to claim 13, wherein the control unit is configured to, upon determining the at least one among the first and second torques is above the respective first and second threshold torques, determine the estimate of the amount of laundry load by setting the selected laundry treatment cycle for a maximum amount of laundry load accepted by the laundry treatment appliance.

15. The laundry appliance according to claim 11, wherein the control unit is configured to display at least one of the first time duration and the second time duration on a user interface.

16. A laundry treatment appliance comprising:

a rotatable drum configured to house a laundry load;

an electric motor configured to rotate the rotatable drum;

a compartment configured to contain multiple doses of a treatment agent for laundry treatment; and a control unit, wherein the control unit is configured to:

(1) before any delivery of water to the laundry load during a selected laundry treatment cycle:

control the electric motor to rotate the rotatable drum with a predefined speed profile portion and a constant speed profile portion;

determine a first estimate of the amount of laundry load according to one or more parameters of the electric motor being acquired during rotation of the rotatable drum with the predefined speed profile; and according to the estimate of the amount of laundry load, determine a treatment agent dose to be used during the selected laundry treatment cycle;

(2) upon determining that the estimate of the amount of laundry load is above a threshold amount of laundry load, determine a second estimate of the amount of laundry load based on water absorption by the laundry load and determine at least one parameter of the selected laundry treatment cycle based on the second estimate of the amount of laundry load;

(3) upon determining the estimate of the amount of laundry load is below the threshold amount of laundry load, determine the at least one parameter of the selected laundry treatment cycle based on the estimate of the amount of laundry load; and (4) after having determined the treatment agent dose to be used during the selected laundry treatment cycle: deliver water and the determined treatment agent dose to the laundry load.

17. The laundry treatment appliance of claim 16, wherein the predefined speed profile comprises a ramp speed profile portion in which the rotatable drum is accelerated from a first rotational speed to a second rotational speed higher than the first rotational speed.

18. The laundry treatment appliance of claim 16, wherein the control unit is configured to deliver the determined treatment agent dose and the water at least partially at the same time.

19. The laundry treatment appliance of claim 16, wherein the one or more parameters of the electric motor comprises a torque of the electric motor.

20. The laundry treatment appliance of claim 17, wherein the control unit is configured to determine a first torque and a second torque of the electric motor during rotation of the rotatable drum with the ramp speed profile portion and constant speed profile portion, respectively, and to determine the estimate of the amount of laundry load according to the first torque and the second torque.

* * * * *